US007240632B1

(12) United States Patent
Wynne et al.

(10) Patent No.: US 7,240,632 B1
(45) Date of Patent: Jul. 10, 2007

(54) PERSONAL WATERCRAFT CENTER KEEL

(75) Inventors: Dallas B. Wynne, Spirit Lake, IA (US); Bradley R. Morisch, Okoboji, IA (US)

(73) Assignee: Polaris Industries Inc., Medina, MN (US)

( * ) Notice: Subject to any disclaimer, the term of this patent is extended or adjusted under 35 U.S.C. 154(b) by 0 days.

(21) Appl. No.: 10/607,177

(22) Filed: Jun. 25, 2003

(51) Int. Cl.
*B63B 3/38* (2006.01)
*B63B 35/73* (2006.01)
*B63B 1/18* (2006.01)
*B63B 1/32* (2006.01)

(52) U.S. Cl. ..... 114/140; 114/55.5; 114/61.33; 114/288

(58) Field of Classification Search ..... 114/288–290, 114/55.5, 55.55, 55.57, 61.32, 61.33, 140; 440/68–70; D12/307, 310–312
See application file for complete search history.

(56) References Cited

U.S. PATENT DOCUMENTS

| | | | | |
|---|---|---|---|---|
| 1,202,713 | A * | 10/1916 | Hedges | 114/2 |
| 2,249,958 | A * | 7/1941 | Inwood | 114/61.33 |
| 3,067,711 | A * | 12/1962 | Hesher et al. | 114/290 |
| 3,363,598 | A | 1/1968 | Mortrude | 114/66.5 |
| 3,937,173 | A * | 2/1976 | Stuart | 440/69 |
| 4,609,360 | A * | 9/1986 | Whitehead | 440/69 |
| 4,760,810 | A * | 8/1988 | Kobayashi | 114/290 |
| 4,932,347 | A * | 6/1990 | Mardikian | 114/55.52 |
| 5,141,456 | A * | 8/1992 | Langenberg et al. | 440/66 |
| 5,199,373 | A * | 4/1993 | Mardikian | 114/288 |
| 5,255,626 | A * | 10/1993 | Hattori et al. | 114/55.53 |
| 5,390,621 | A * | 2/1995 | Hattori et al. | 114/55.51 |
| 5,405,278 | A * | 4/1995 | Garland | 440/69 |
| 5,655,473 | A * | 8/1997 | Arvilla | 114/61.1 |
| 6,112,685 | A | 9/2000 | Matsuda et al. | 114/55.53 |
| 6,237,522 | B1 | 5/2001 | Kiyohara et al. | 114/290 |
| D464,016 | S | 10/2002 | Orr et al. | D12/307 |
| 6,675,736 | B1 * | 1/2004 | Schreiber et al. | 114/290 |
| 6,863,013 | B2 * | 3/2005 | Noyes, Jr. | 114/285 |
| 2002/0182949 | A1 | 12/2002 | Tanaka et al. | 440/88 |

FOREIGN PATENT DOCUMENTS

| | | | |
|---|---|---|---|
| FR | 2387840 | A * | 12/1978 |
| FR | 2636295 | A1 * | 3/1990 |
| FR | 2806696 | A1 * | 9/2001 |
| JP | 62247994 | A * | 10/1987 |

* cited by examiner

*Primary Examiner*—Ajay Vasudeva
(74) *Attorney, Agent, or Firm*—Baker & Daniels LLP

(57) ABSTRACT

A personal watercraft having improved bottom hull shapes in general, and improved center keel shapes in particular. The center keel can have a substantial section over which the keel angle becomes sharper progressing from front to rear, and the concavities on either side of the center keel become deeper progressing from front to rear. The center keel can have a point of maximum downward slope on either side of the keel centerline, with the maximum vertically downward slope becoming greater with greater rearward distance over a section of the personal water craft bottom hull. The bottom hull can have keel troughs on either side of the keel centerline that become deeper over a section of the personal watercraft bottom hull, traveling from front to rear over that selected section of personal watercraft bottom hull. The center keel shape can provide a smoother ride and improved handling in rough water. When the bottom hull is in the water, the sharper keel angle and deeper troughs leading to the transition region and the tunnel of the watercraft can more effectively channel water to the tunnel and to the jet pump.

28 Claims, 11 Drawing Sheets

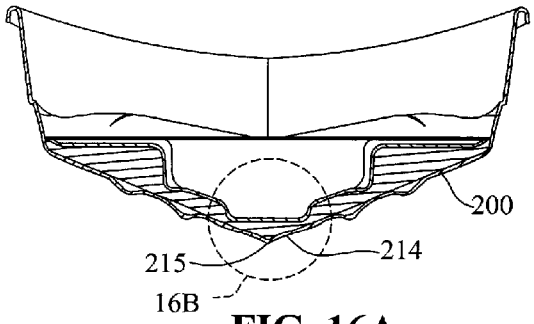
FIG. 16A
FIG. 16B
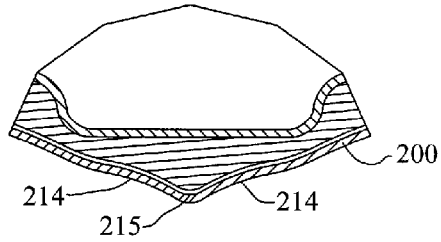
FIG. 17A
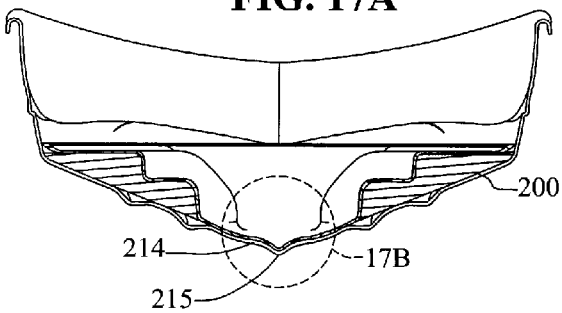
FIG. 17B
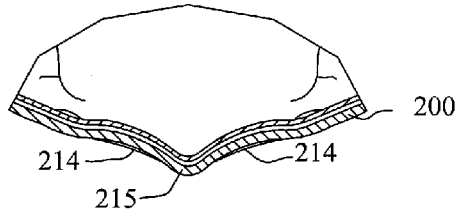
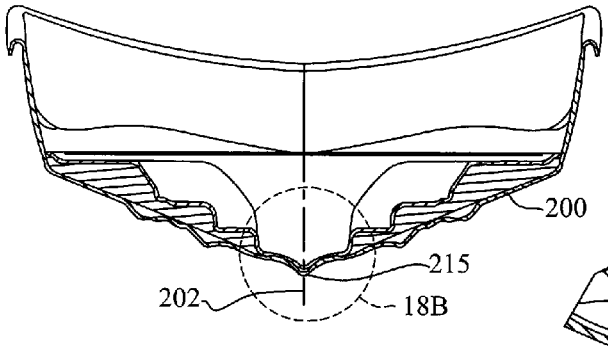
FIG. 18A
FIG. 18B
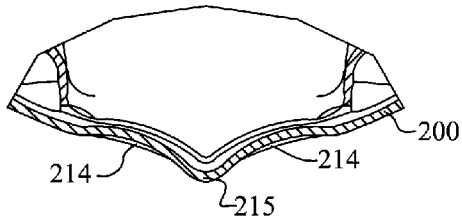

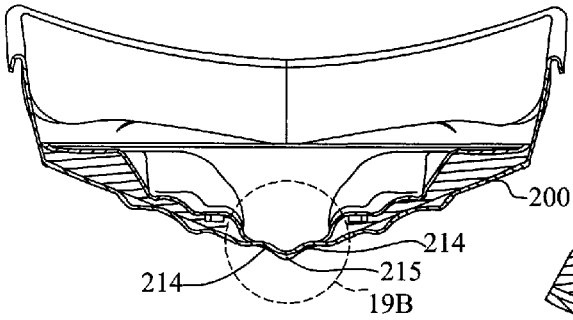
FIG. 19A
FIG. 19B
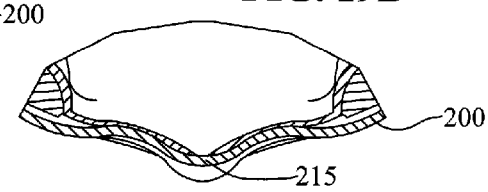
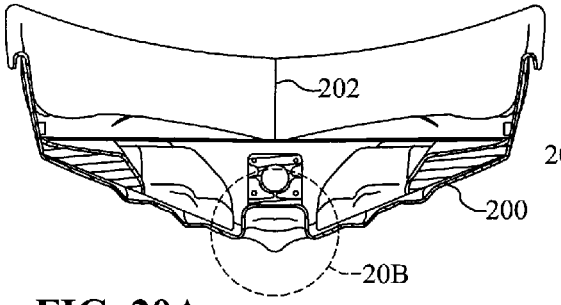
FIG. 20A
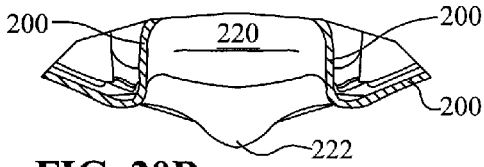
FIG. 20B
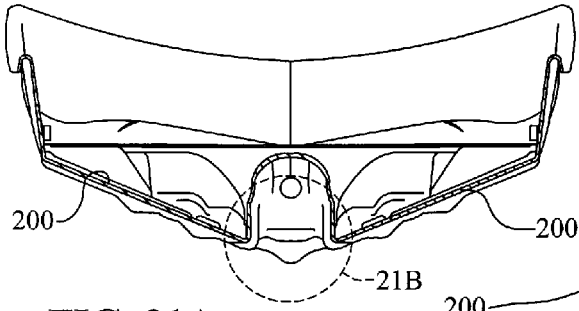
FIG. 21A
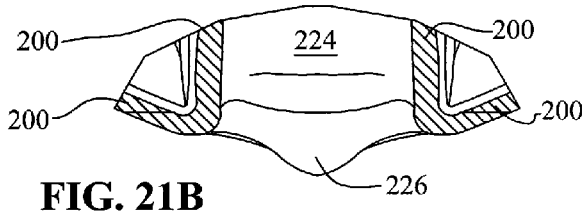
FIG. 21B

PERSONAL WATERCRAFT CENTER KEEL

FIELD OF THE INVENTION

The present invention is related generally to personal watercraft. More specifically, the present invention is related to personal watercraft hull and keel shapes.

BACKGROUND OF THE INVENTION

Personal watercraft hull designs typically have a center keel shape that remains essentially constant over the length of the watercraft, or transitions to a flatter, shallower keel shape as the tunnel to the rear of the watercraft is approached. Some personal watercraft have substantially rounded, shallow-angled, or even flat center regions, disposed between longitudinal chines running along the underside of the personal watercraft. The conventional design has proved adequate in the past in general, but applicants suspected that the conventional hull design could be changed to improve personal watercraft handling in rough water.

SUMMARY OF THE INVENTION

The present invention provides a section of a personal watercraft center keel that has unique geometry. In the front of this section, the keel can be wider, providing more lift, and riding high on the water. The keel can have a shallow concave trough on either side. In the rear region of this selected section, the keel can be narrower, providing less lift, and cutting deeper down into the water. The keel can also have deeper concavities on either side, forming steeper angles on either side of the center keel. The trough depth on either side of the keel centerline can get progressively deeper progressing rearward in the watercraft over this selected section.

The present invention provides a personal watercraft including a bottom hull including a center keel having a keel surface and a centerline. The center keel can have a longitudinal portion disposed between a front point and a rear point. The keel portion between these points can have a keel angle that is smaller at the rear than at the front. This selected keel portion can be disposed within the middle third of the watercraft in some embodiments. The keel angle may be defined in some embodiments for each location along the centerline. The defined keel angle can be defined as the angle formed between the keel bottom surface at the centerline and two keel bottom surface locations which are disposed transversely away from the centerline at a location of greatest downward slope on the keel surface. In some embodiments, the selected keel portion rear point is located about 1½ feet forward of the jet pump. The selected section can extend about 4½ feet forward of the rear point.

The present invention also includes a personal watercraft hull comprising a center keel portion on the hull having a surface, a length, and a plurality of locations along the keel length through which a transverse cross-section can be taken through the keel. The transverse cross-section has a point of greatest downward slope taken at the surface on each side of the keel where the surface has the greatest downward slope. There exists a keel section having a length over which the greatest downward slope increases from front to rear over the section length. In some embodiments, such a keel section is found within the middle third of the personal watercraft along its length. The center keel portion can be integrally formed with the hull. In some embodiments, the keel section begins about two feet forward of the jet pump and extends forward for about four feet over the length of the section. In one embodiment, the center keel maximum vertical downward slope is greater at a location four feet from the rear-most extent of the watercraft than at a location three feet to the rear of the front-most extent of the watercraft.

The present invention includes a personal watercraft hull having a center keel portion having a surface, a length, and a plurality of locations along the keel length through which a transverse cross-section can be taken through the hull. The keel can have a trough having a trough depth on each side of the keel. There exists a keel section having a length over which the trough depth increases from front to rear over the section length. In some embodiments, such a keel section is found within about the middle third of the personal watercraft length. In some embodiments, the keel section has a length of between about three and five feet and lies within the middle third of the personal watercraft length. In some embodiments, the trough depth is measured as a normal distance from a trough boundary to the hull surface in the trough. In other embodiments, the trough depth is measured as a vertical distance from a midpoint of a trough boundary to the hull surface. In some personal watercraft, the trough depth at a location four feet forward of the rear-most extent of the watercraft is greater than a trough depth located three feet to the rear of the forward most extent of the watercraft.

In previous watercraft, the center keel often started out having a sharp angle at the front of the watercraft, flattening to have a much shallower angle as the tunnel was approached. Applicants were surprised to find that the center keel shape of the present invention increases the lateral resistance to movement and improves stability in the water when cornering. The present invention provides smoother operation of a personal watercraft while allowing for more predictable maneuvering.

DESCRIPTION OF THE DRAWINGS

FIGS. 12A through 22B are transverse, forward looking, cross-sectional views taken through view lines 12 through 22, respectively.

DETAILED DESCRIPTION OF THE PREFERRED EMBODIMENTS

Figure 1:
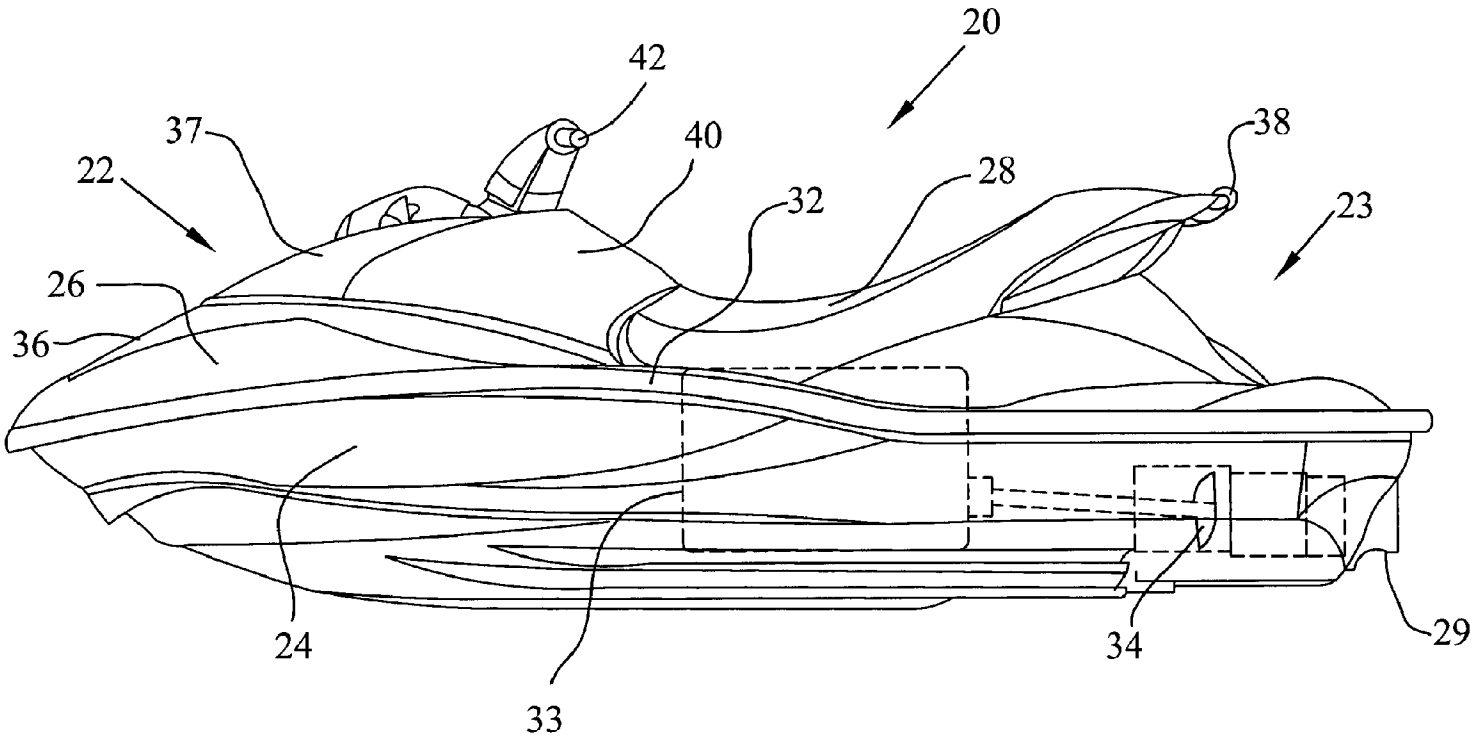
FIG. 1 is a side, cut-away view of a personal watercraft.

The following detailed description should be read with reference to the drawings, in which like elements in different drawings are numbered identically. The drawings depict selected embodiments and are not intended to limit the scope of the invention. Several forms of invention will be shown and described, and other forms will now be apparent to those skilled in art. It will be understood that the embodiments shown in the drawings and described below are merely for illustrative purposes, and are not intended to limit the scope of the invention as defined in the claims that follow.

FIG. 1 illustrates a personal watercraft 20 having generally a front or bow 22 and a rear or stern 23. Personal watercraft 20 includes a top deck 26 secured to a bottom hull 24 along an overlapping portion covered with a rub rail 32 in the embodiment illustrated, forming a hull. A hood 37 may also be seen, joined to top deck 26 at a hinged front hood portion 36. The hull formed by the bottom hull 24 and top deck 26 define a compartment sized to contain an internal combustion engine 33 for powering the watercraft, and may also include one or more storage compartments, depending upon the size and configuration of the watercraft. The deck portion 26 also has a raised, longitudinally extending seat 28 adapted to accommodate one or more riders seated in straddle fashion on the seat 28. A grab handle 38 is disposed transversely across the rear of the seat. Engine 33 powers a jet propulsion unit 34, typically mounted in a tunnel at the bottom rear portion of the watercraft, all shown in phantom in FIG. 1. Jet propulsion unit 34 includes a steerable water discharge nozzle 29 that is operatively connected to a set of handlebars 42 to facilitate steering of the watercraft by the operator. Handlebars 42 typically mount through a top portion of a shroud 40. The connection between handlebars 42 and discharge nozzle 29 may be of any suitable type, and typically includes mechanical linkages including a control cable. If desired, an electronic connection could also be utilized.

Figure 2:
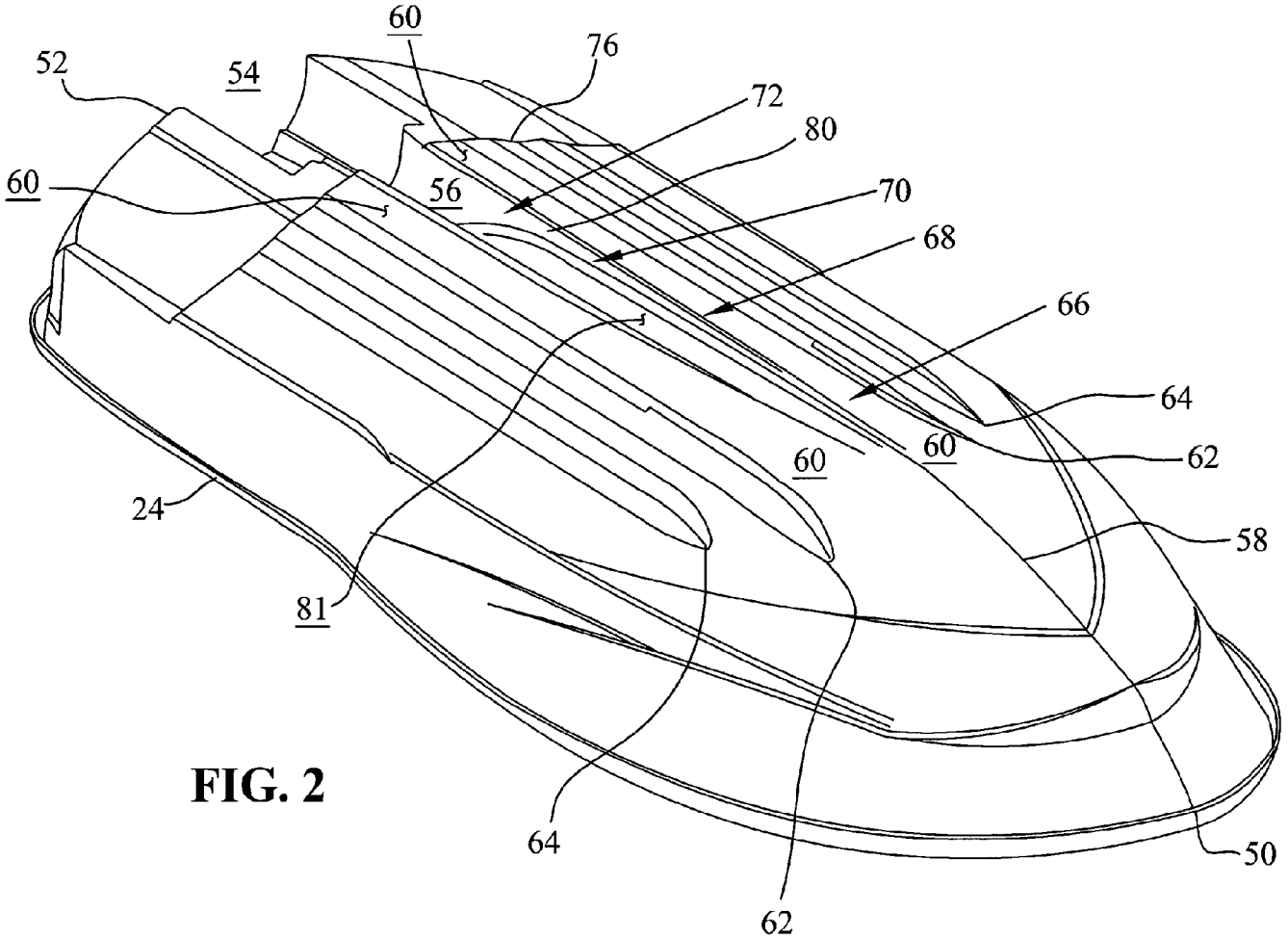
FIG. 2 is a bottom, perspective view of the personal watercraft of FIG. 1 having a center keel that begins with a shallow angle having shallow troughs on either side, proceeding rearward to have a sharper keel angle with deeper troughs.

FIG. 2 illustrates bottom hull 24 of FIG. 1 in a perspective, bottom view. Hull 24 extends generally between a front-most extent 50 and a rear-most extent 52. Hull 24 includes a centerline 58. A center keel 80 may be seen having a trough 81 on either side in some regions. Keel 80 has a front region 66, an intermediate region 68, a rear region 70, and a transition region 72 in which the keel transitions or disappears into a large concavity 56 that transitions between keel 80 and a tunnel 54. A grate can be placed over the transition region 56 and a pump to hull interface having a large aperture can be mounted perpendicular to the hull at the fore region of tunnel 54. A jet pump can be mounted within tunnel 54 and the tunnel protected with a ride plate. Hull 24 may also be seen to have a transition region 76 laterally extending on either side of keel 80 just forward of tunnel 54 and in the rear portion of transition region 56.

Hull 24 also includes a first pair of longitudinal strakes 62 and a more outer, second pair of longitudinal strakes 64. Center keel 80 and surrounding troughs 81 are located in a local, longitudinal strip 60 of hull 24. Longitudinal, local strip 60 can be used to effectively describe the local geometry of the center keel and troughs.

Figure 3:
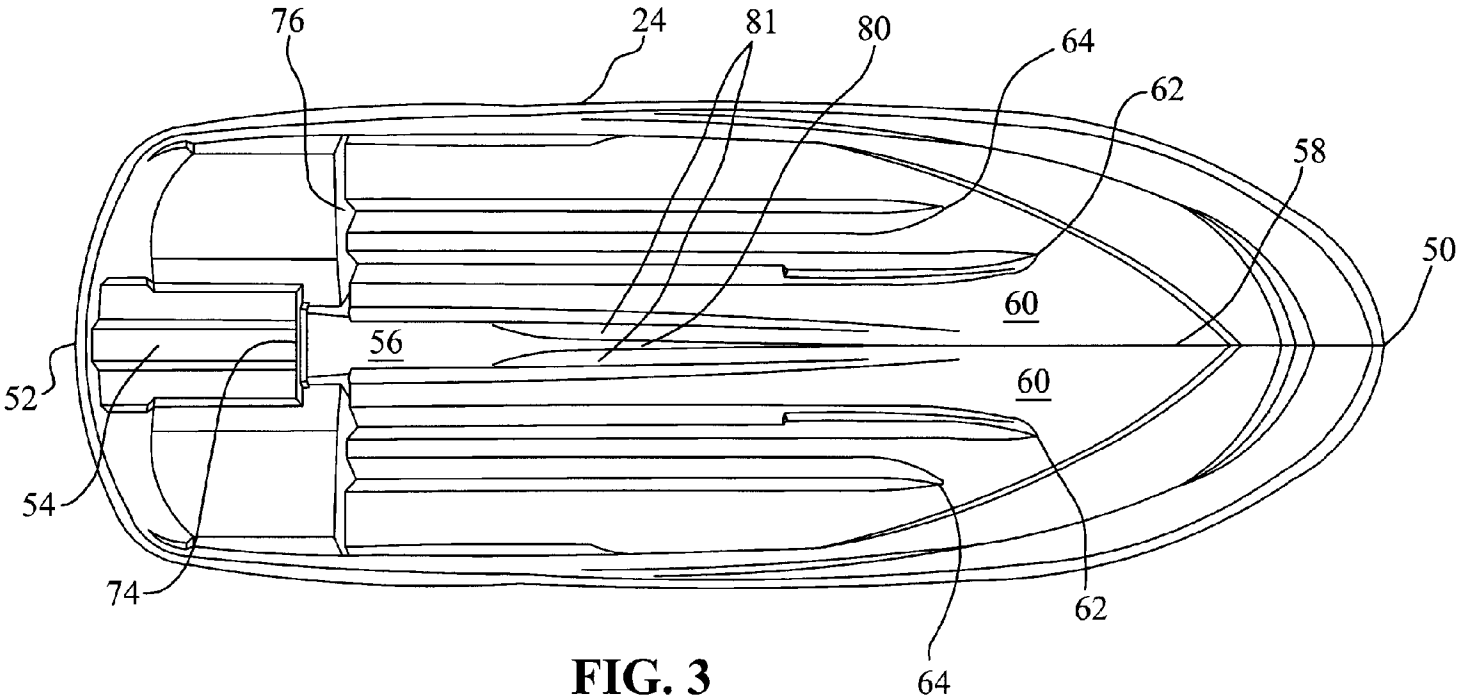
FIG. 3 is a bottom view of the hull of FIG. 2.

FIG. 3 illustrates hull 24 from the bottom, illustrating front-most extent 50, centerline 58, rear-most extent 52, tunnel 54, and transition region 56, as previously described with respect to FIG. 2. FIG. 3 also illustrates hull lateral transition region 76, center keel 80, center keel troughs 81, first strakes 62, second strakes 64, and center keel longitudinal strip 60, also previously described with respect to FIG. 2. Tunnel 54 can include a pump to hull interface having a large water intake orifice at 74 that can be located in the tunnel to provide water to the jet pump from transition region 56.

Figure 4:
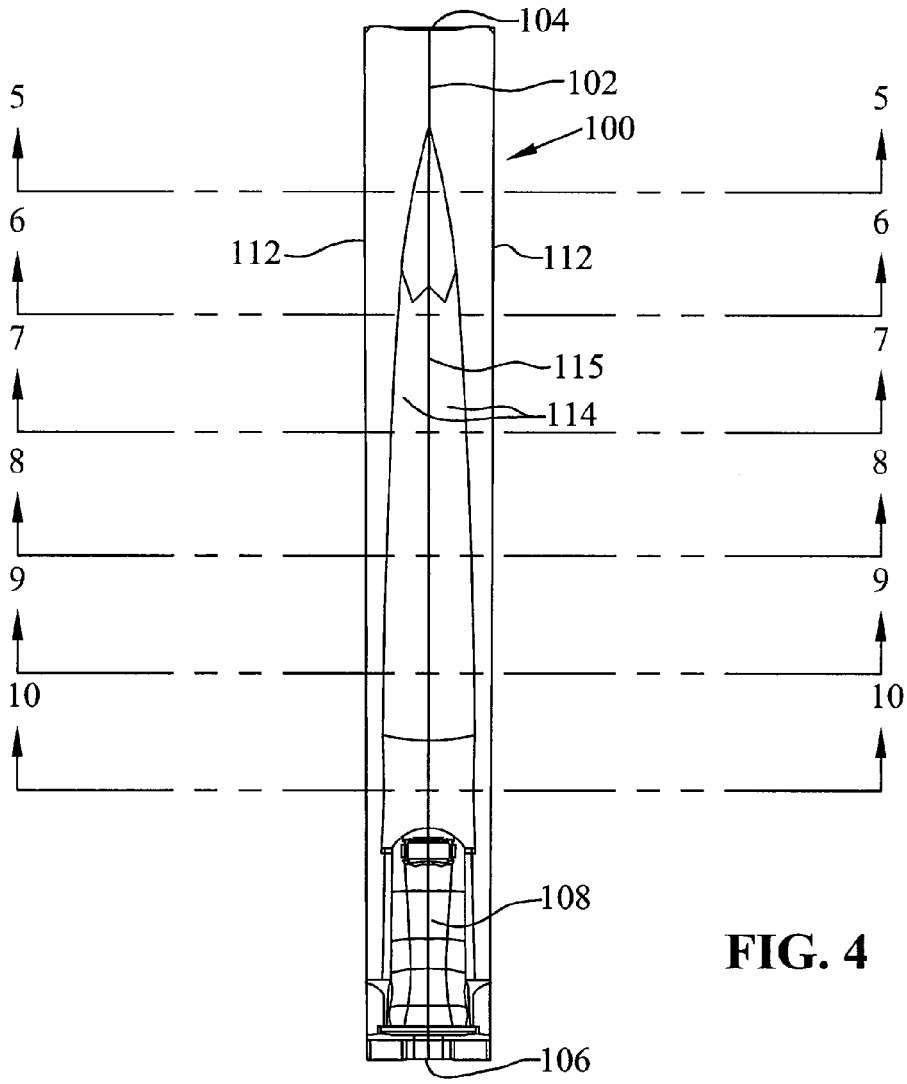
FIG. 4 is a fragmentary view of a personal watercraft bottom hull taken about either side of the personal watercraft centerline, from a front extent, to a rear extent, showing view lines 5 through 10, corresponding to FIGS. 5 through 10.

FIG. 4 illustrates a partial longitudinal strip 100 of a personal watercraft hull 101 lying between a pair of parallel, longitudinal lines 112. Longitudinal strip 100 extends along a centerline or vertical center-plane 102 between a front extent 104 and rear extent 106. In the example of the invention depicted in FIG. 4, the total watercraft length is about 126 inches long. The watercraft extends about 20 inches rearward of rear extent 106 and about 25 inches forward of the front extent 104. FIG. 4 thus illustrates the portion of the watercraft hull between about 16 percent of the way from the rear-most extent and about 20 percent of the way from the front-most extent of the watercraft. FIG. 4 illustrates a vertical projection of a hull onto a plane, rather than the curved hull after being laid or rolled down onto a plane. Longitudinal strip 100 includes a center keel 115 having center keel troughs 114 on either side. Centerline 102 extends through a transition region 108 leading to a tunnel located to the rear of rear extent 106. In the embodiment illustrated in FIG. 4, the distance from front extent 104 to rear extent 106 is about 80 inches. Longitudinal strip 100 is about 10 inches in width in FIG. 4. FIG. 4 includes several forwardly looking view lines 5 through 10. View lines 5 through 10 are about 10 inches apart and describe the location of the drawings in FIGS. 5 through 10.

FIGS. 5 through 10 describe a forward-looking, transverse cross-sectional view taken through bottom hull longitudinal strip 100 of FIG. 4. FIGS. 5 through 10 proceed from front to rear along the watercraft hull. The geometry of the local region of the center keel may be best described by initially discussing FIG. 8.

Figure 8:
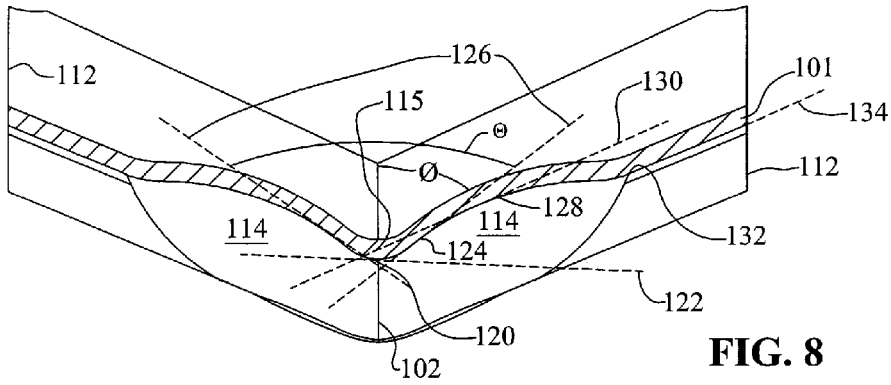

FIG. 8 illustrates a transverse, cross-sectional view through bottom hull longitudinal strip 100 of FIG. 4, taken through view line 8—8, looking forward. Bottom hull 101 includes center keel 115 and center keel troughs 114 disposed on either side. FIG. 8 has been selected to illustrate the vertical slope and the region of greatest vertical slope of the center keel in a cross-section. At a center point 120, on the outside surface of hull 101, along centerline 102, a line 122 has been drawn tangent to point 120. Line 122 may be seen to be horizontal, having no vertical slope component. Extending transversely outward along the cross-section, a second point 124 may be seen, disposed on the hull outer surface in the trough region. A tangent line 126 may be seen drawn through tangent point 124. Tangent line 126 has the maximum vertical slope taken along the keel surface within the longitudinal strip of this cross section. A second tangent line 126 may also be seen on the opposite side of centerline 102. A "keel angle" $\theta$ may be defined between the two centerlines 126. A "keel side angle" $\phi$ may be defined between vertical and tangent line 126, also illustrated in FIG. 8. Traveling still further outward from centerline 102, another point 128 has been selected on the hull surface. A tangent line 130 has been drawn through surface point 128. It may be seen that the vertical slope of tangent line 130 has decreased relative to that of tangent line 126. Proceeding still further outward from centerline 102, yet another point 132 has been selected on the outer surface of hull 101, where the hull shape begins to be essentially flat for a region. A tangent line 134 has been drawn through surface point 132, illustrating the still decreasing vertical slope of the hull surface, relative to that of point 124.

As used herein, "the point of greatest vertical slope in a cross-section" refers to the first maximum vertical slope region encountered when proceeding outward from the centerline. This slope extends downwardly and inwardly toward the center keel. Inspection of FIG. 8 shows that a bulge or strake near point 132 could have a large vertical slope oriented downward and outward. This is not the maximum vertical slope described with respect to the center keel maximum vertical slope as the vertical slope is both not the first maximum encountered when traveling outward from a centerline and is also disposed outwardly and downwardly rather than inwardly and downwardly.

Figure 9:
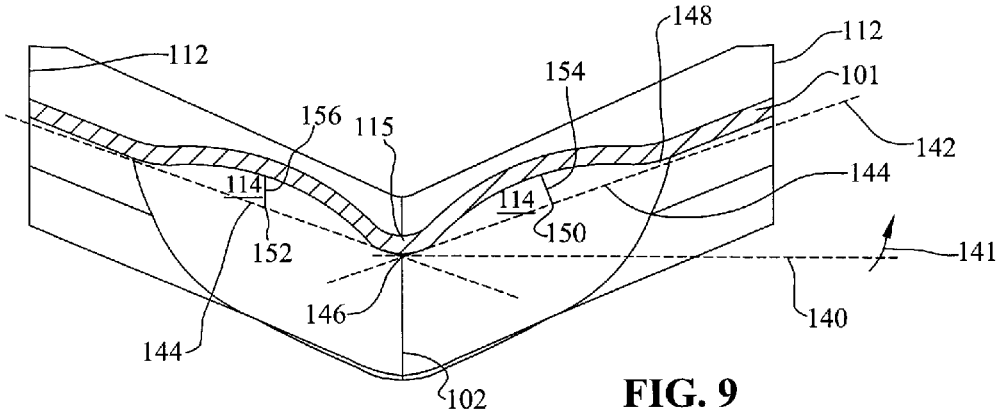

FIG. 9 may be used to illustrate another aspect of the present invention. FIG. 9 illustrates the geometric nature of troughs 114. A horizontal line 140 may be seen contacting center keel 115 at centerline 102. Line 140 is a tangent line illustrating how a long, rigid member first end may be placed against center keel 115 at the outside surface at the centerline. The rigid member in some embodiments can be sufficiently long, for example, having a second end extending past the side of the watercraft so as to not fall into a local minimum. In other views of the invention, the rigid member may have a length just long enough to fall short of the most inward longitudinal strake. The rigid member may then be pivoted as indicated at 141 to assume the position indicated by line 142. The rigid member has thus been pivotally rotated upward until it first contacts hull 101. Note that in some hull geometries, after being pivotally rotated upward, line 141 may no longer contact center keel 115 at centerline 102. Rather, line 142 should still cross centerline 102 but may no longer contact the outer surface of hull 101 at centerline 102. Line 142 thus forms a "trough boundary" indicated at 144. Trough boundary 144 is the boundary established by the rigid member previously discussed. The boundary lies in a vertical plane that extends transversely away from and perpendicular to centerline 102.

Trough boundary 144 may be seen to extend between a first end 146 where boundary 144 crosses centerline 102, or a downward projection of centerline 102, and the opposite end of boundary 144 where the boundary encounters the outer hull surface for the first time at point 148. The trough may be seen to have a maximum depth indicated at 154 at a point of maximum depth, indicated at 150. The trough depth 154 has been taken as a normal, maximum distance between trough boundary 144 and hull 101 in trough 114. Trough boundary 144 may also be seen to have a midpoint 152 that can also be used to establish a measurement point for the trough depth. The trough depth may be taken as a normal or perpendicular distance between midpoint 152 and hull 101 at trough 114. The trough depth may also be measured as indicated by depth 156, taken as a vertical distance from trough boundary midpoint 152 until hull 101 outer surface is encountered.

Figure 5:
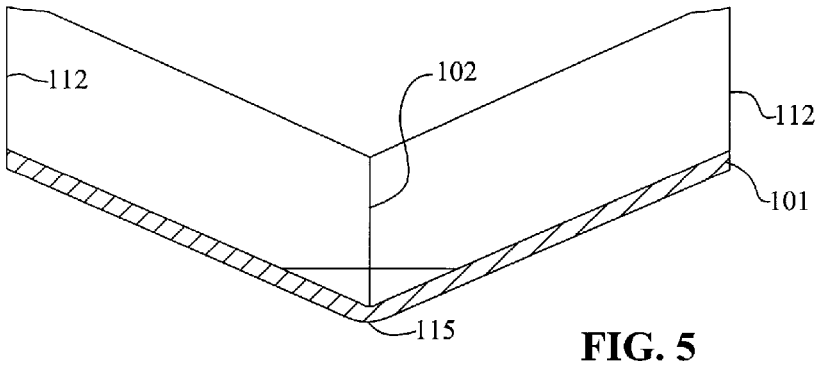
FIGS. 5 through 10 are fragmentary, transverse, forward-looking cross-sectional views taken through view lines 5 through 10 of FIG. 4, respectively.

The change in hull geometry, and more particularly, center keel geometry may be discussed by referring back to FIG. 5. FIG. 5 illustrates bottom hull 101 between lines 112, centered on centerline 102. Bottom hull 101 includes center keel 115. FIGS. 5 through 10, unless otherwise indicated, are to scale. Specifically, lines 112 may be considered to be 10 inches apart, with the vertical and horizontal dimensions of FIGS. 5 through 10 being the same as between the horizontal and vertical dimensions and as between FIGS. 5 through 10. Additionally, FIGS. 5 through 10 may be measured and compared as between each other to better understand one embodiment of the present invention.

FIG. 5 is a forward-looking, transverse, cross-sectional view taken between lines 112 that are about 10 inches apart. The section taken through the center keel longitudinal strip is located about 27 percent of the way between the front-most and rear-most extents of the hull, about 34 inches from the front-most extent in the embodiment illustrated. Center keel 115 may be seen to have an essentially constant vertical slope extending outward from centerline 102 to line 112 limiting the outward extend of the longitudinal strip illustrated in FIG. 5. Center keel 115 of FIG. 5 also has essentially no trough depth, as there is essentially no trough at this location.

Figure 6:
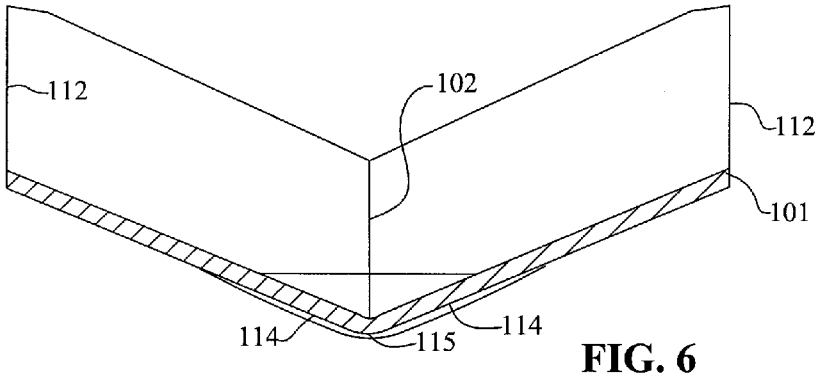

FIG. 6 illustrates another forward-looking, transverse, cross-sectional view through hull longitudinal strip 100 of FIG. 4, taken about 35 percent of the distance from the front-most portion of the watercraft to the rear-most portion of the watercraft. This is about 44 inches from the front-most extent of the watercraft in the embodiment illustrated. Very small troughs 114 may be seen to be formed on either side of centerline 102. In this region, center keel 115 begins to have a maximum downward vertical slope that is slightly larger than that over longitudinal section 100 as a whole.

Figure 7:
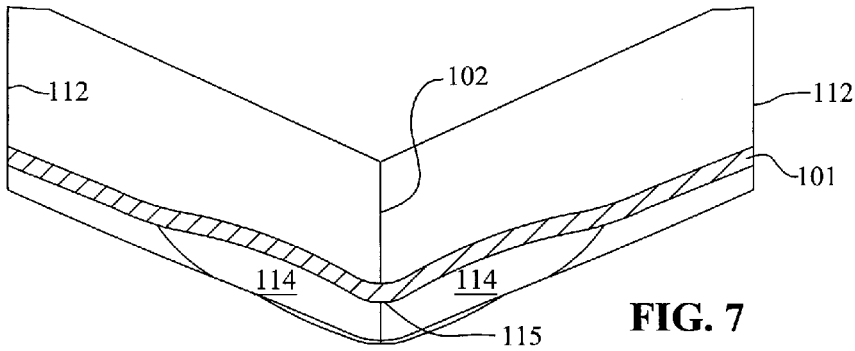

FIG. 7 illustrates another forward-looking, transverse, cross-sectional view taken through view lines 7—7 of FIG. 4. FIG. 7 is taken about 43 percent of the distance from the front-most extent of the watercraft to the rear-most extent of the watercraft, about 54 inches in the embodiment illustrated. Center keel 115 may be seen to have a more vertically downward inflection. Center keel 115 includes troughs 114 on either side, formed by center keel 115 having a vertically downward slope that increases as hull 101 is traveled from centerline 102 to lines 112.

FIG. 8 illustrates a forward-looking, transverse, cross-sectional view taken through view line 8—8 of FIG. 4. FIG. 8 is taken about 51 percent of the distance from the front-most extent to the rear-most extent of the watercraft, about 64 inches in this embodiment. FIG. 8 was previously discussed to describe the geometry of the center keel. The maximum vertically downward slope of FIG. 8 has increased relative to that of FIG. 7. The trough depth of FIG. 8 has also increased relative to that of FIG. 7. The "keel angle" or "downward keel angle" has thus decreased from FIG. 7 to FIG. 8, as the bottom hull is traveled from front to rear.

FIG. 9 illustrates a forward-looking, transverse, cross-sectional view taken through view line 9—9 of FIG. 4. FIG. 9 is taken about 59 percent of the distance from the front-most extent to the rear-most extent of the personal watercraft, about 74 inches in the embodiment illustrated. FIG. 9 was previously discussed to describe the trough depth and trough boundaries of the present invention. The keel angle and the maximum vertical downward slope of the center keel have increased from FIG. 8 to FIG. 9. Likewise, the trough depth has also increased, proceeding forward from FIG. 8 to FIG. 9.

Figure 10:
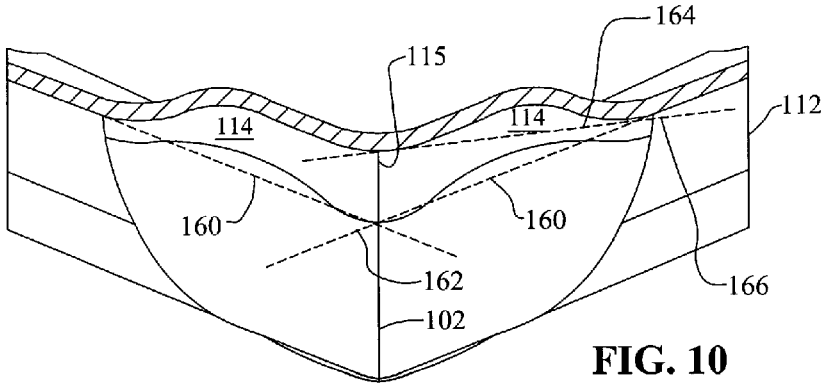

FIG. 10 illustrates yet another forward-looking, transverse, cross-sectional view taken through view line 10—10 of FIG. 4. FIG. 10 is located about 67 percent of the distance from the front-most extent to the rear-most extent of the watercraft, about 84 inches, in the present embodiment. FIG. 10 is taken in a hull transition region. Center keel 115 may be seen as may center keel troughs 114 on either side. A tangent line 160 may be seen extending inward from the more outward location of the hull. Tangent lines 160 may be seen to intersect at point 162, well below the outer surface of center keel 115. A trough boundary line 164 may be seen, extending between centerline 102 and the first contact point indicated at 166. The trough depth and the maximum vertical downward slope of the center keel in FIG. 10 may be seen to have both decreased relative to that of FIG. 9.

Comparing FIGS. 5 through 10, the transition from a center keel having essentially no troughs on either side and a constant vertically downward slope across its cross-section, to a more vertically downward center keel having deeper troughs on either side may be seen.

Figure 11:
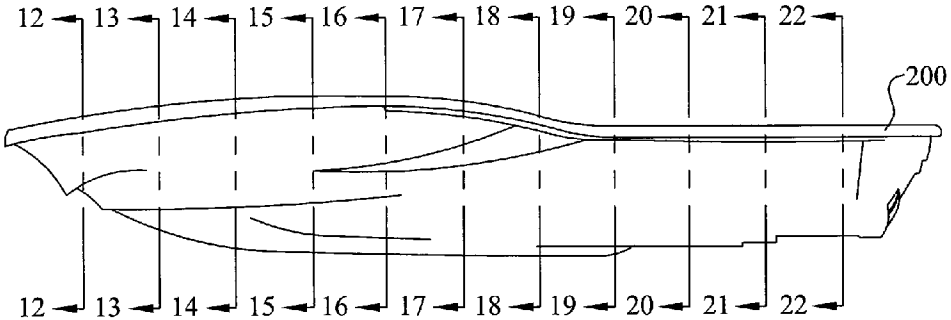
FIG. 11 is a side view of a personal watercraft bottom hull, having view lines 12 through 22, corresponding to FIGS. 12A and 12B through FIGS. 22A and 22B, respectively.

FIG. 11 illustrates another personal watercraft bottom hull 200 having forward-looking view lines 12 through 22, corresponding to FIGS. 12A and 12B through FIGS. 22A and 22B, respectively.

Figure 12A:
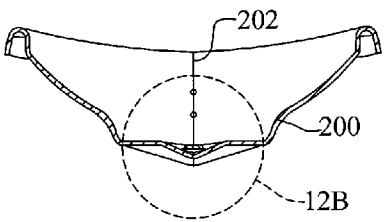
Figure 12B:
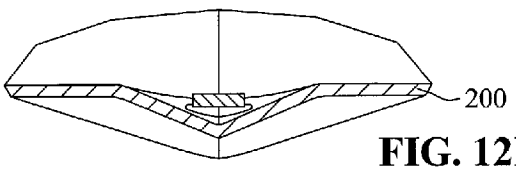

FIG. 12A is a forward-looking, transverse, cross-sectional view taken through bottom hull 200, through view line 12 of FIG. 11. FIG. 12A is taken about 8 percent of the distance from the front-most extent of the personal watercraft to the rear-most extent of the personal watercraft, about 10 inches in the embodiment illustrated. FIG. 12B is a detailed view of FIG. 12A. FIGS. 12A and 12B through FIGS. 22A and 22B may be understood to have the same vertical and horizontal scale within each drawing. The scale of the different. FIGS. 12A through 22A is the same as between these drawings. The similar scales as between the drawings better illustrates the embodiment of the invention illustrated, but the invention is of course not limited to this one embodiment. FIG. 12A includes a centerline or vertical center plane 202 extending through bottom hull 200. A center region may be seen.

Figure 13A:
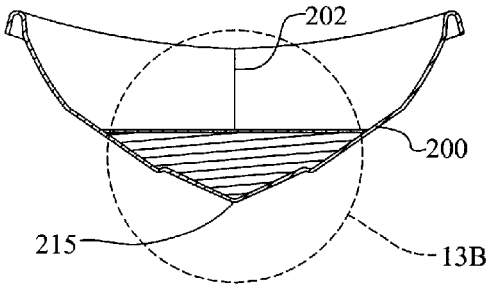
Figure 13B:
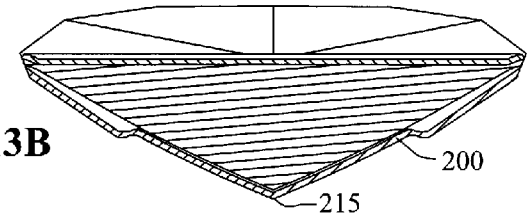

FIGS. 13A and 13B illustrate a forward-looking, transverse, cross-sectional view taken through view line 13 of FIG. 11. FIG. 13 is located about 16 percent of the distance from the front-most to the rear-most extent of the bottom hull. In the embodiment illustrated, this distance is about 20 inches from the forward most extent of the personal watercraft. A center keel 215 may be seen to be essentially having no trough on either side and no change in the maximal vertical downward slope traveling away from center keel 215.

Figure 14A:
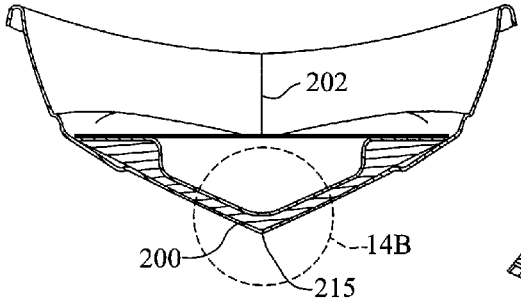
Figure 14B:
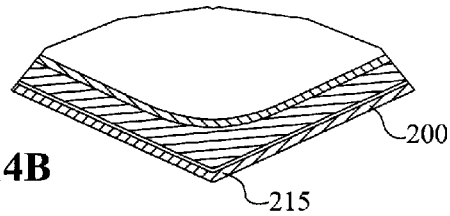

FIGS. 14A and 14B illustrate a forward-looking, transverse, cross-sectional view taken through view line 14 of FIG. 11. FIG. 14 is taken through a section located about 24 percent of the distance from the front-most extent to the rear-most extent of the personal watercraft, about 30 inches in the present embodiment. As may be seen in FIGS. 14A and 14B the bottom-hull has essentially no keel troughs on either side of the centerline.

Figure 15A:
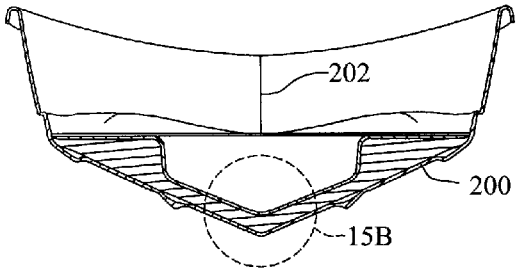
Figure 15B:
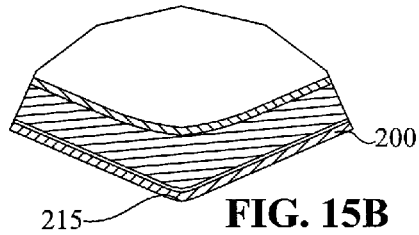

FIGS. 15A and 15B are taken about 32 percent of the distance from the front-most extent to the rear-most extent of the personal watercraft, about 40 inches in this embodiment. No troughs are yet visible.

FIGS. 16A and 16B are taken through view line 16 of FIG. 11. FIGS. 16A and 16B are taken about 40 percent of the distance from the front-most extent to the rear-most extent of the watercraft, about 50 inches in this embodiment. Slight troughs 214 may be seen disposed on either side of center keel 215.

FIGS. 17A and 17B are taken about 48 percent of the distance from the front-most extent to the rear-most extent of the personal watercraft hull of FIG. 11. This is about 60 inches from the front-most extent in the embodiment illustrated. Troughs 214 may be seen to have a greater depth relative to those in FIGS. 16A and 16B. The maximum downward vertical slope of the center keel in FIGS. 17A and 17B likewise is greater than that illustrated in FIGS. 16A and 16B.

FIGS. 18A and 18B are taken through view line 18 of FIG. 11, about 56 percent of the distance from the front-most extent to the rear-most extent of bottom hull 200, about 70 inches from front-most extent in this embodiment. The downward keel angle may be seen to be more pronounced relative to that of FIGS. 17A and 17B. The trough depth may also be seen to be deeper relative to that of FIGS. 17A and 17B.

FIGS. 19A and 19B are taken about 64 percent of the distance from the front-most extent to the rear-most extent of the personal watercraft bottom hull, about 80 inches from the front-most extent in the embodiment illustrated. The downward keel angle has decreased slightly relative to that of FIGS. 18A and 18B, as has the trough depths on either side of the center keel.

FIGS. 20A and 20B are taken through view line 20 of FIG. 11, about 71 percent of the distance from the front-most to the rear-most extent of the watercraft, about 90 inches in the embodiment illustrated. The watercraft bottom hull has begun rising up in a transition region 220 to meet the tunnel. The more forwardly located projection of the center keel may be seen at 222.

FIGS. 21A and 21B are taken through view line 21 of FIG. 11, about 79 percent of the distance from the front-most extent to the rear-most extent, about 100 inches in the present embodiment. Bottom hull 200 now rises almost directly upward to form tunnel 224. The forwardly located center keel may be seen as indicated at 226. 226 is a forward projection of the center keel, which, of course, is not downwardly protruding within tunnel 224.

Figure 22A:
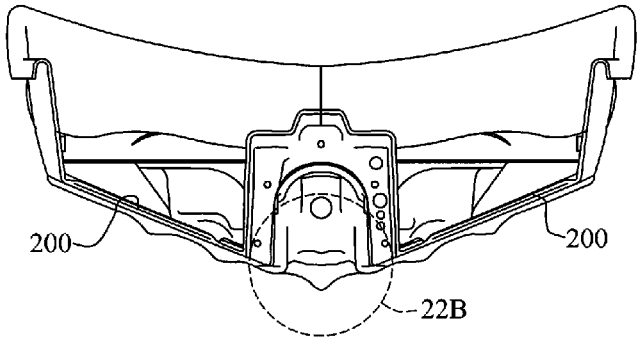
Figure 22B:
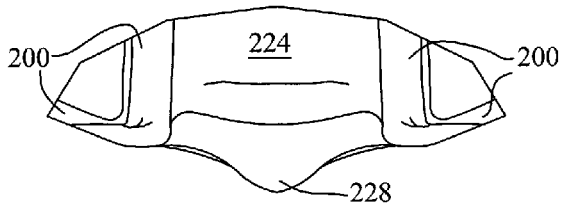

FIGS. 22A and 22B are taken through view line 22 of FIG. 11. FIGS. 22A and 22B are taken about 87 percent of the distance from the front-most extent to the rear-most extent of the personal watercraft, about 110 inches in the embodiment illustrated. The embodiment illustrated in FIG. 11 is about 10½ feet long or 126 inches in length. Bottom hull 200 continues to rise upward to form bottom tunnel 224. The center keel may be seen in the background, as indicated at 228, well forward of the cross-section illustrated in FIGS. 22A and 22B.

The natural attitude of a watercraft at full speed is for the bow to be slightly up. On most current keel designs, the front is steep and sharp, and the rear is soft and shallow. During rough water operation, the rear section of the keel, having a soft shallow angle, is supported by the top version of the waves, the "peak" of the waves. Having a steeper, sharp section on the front portion of the keel will "cut" down to the lower portions of the waves, the "valley" of the waves. This can cause the hull to ride flat in the rough water. The present invention helps the bow ride slightly higher than the stern for proper attitude control and smoother ride in rough water conditions.

The present invention provides a personal watercraft that cuts through rough water in an improved fashion. In a rough water situation, where the boat is coming in and out of the water, applicants believe that the present design takes better advantage of the time when the hull is in the water. Applicants also believe that more of the water that the watercraft hull hits is channeled to the inlet and to the pump. This is as opposed to diverting it outside of the inlet. A shallow keel shaped just ahead of the tunnel or tunnel transition region may force water outward toward the sides to a great extent. The present invention, using the steeper keel angle and the larger concave troughs having greater depth on either side, can actually channel water better to the transition region and a tunnel and jet pump.

The invention claimed is:

1. A personal watercraft comprising:

a hull including a bottom hull and a top deck secured over the bottom hull, the hull defining an engine compartment sized to contain an internal combustion engine for powering a jet propulsion unit, the jet propulsion unit including a steerable water discharge nozzle, the top deck having a raised, longitudinally extending seat adapted to accommodate an operator in straddle fashion, the bottom hull including a generally V-shaped center keel having a keel surface and a centerline, wherein the bottom hull has a longitudinal portion lying between a front limit and a rear limit in which the keel has a central keel angle that is smaller at the rear limit than at the front limit, and the front and rear limits being defined within the middle third of the length of the bottom hull.

2. A personal watercraft as in claim 1, in which the keel angle at a location along the centerline is defined as the angle formed between the keel bottom surface at the centerline and two keel bottom surface locations which are disposed transversely away from the centerline.

3. A personal watercraft as in claim 2, in which the keel lies within the middle third of the personal watercraft length.

4. A personal watercraft as in claim 1, in which the personal watercraft includes a rear-most extent, in which the keel rear begins within about 3½ feet forward of the rear-most extent, and in which the front limit is located at least about 4½ feet forward of the keel rear limit.

5. A personal watercraft as in claim 1, in which the personal watercraft includes a rear-most extent, in which the keel rear begins within about 4 feet forward of the rear-most extent, and in which the front limit is located at least about 3 feet forward of the keel rear limit.

6. A personal watercraft as in claim 1, in which the personal watercraft includes a rear-most extent, in which the keel rear begins within about 4 feet forward of the rear-most extent, and in which the front limit is located at least about 5 feet forward of the keel rear limit.

7. A personal watercraft as in claim 1, in which the personal watercraft includes a rear-most extent, in which the keel rear begins within about 5 feet forward of the rear-most extent, and in which the front limit is located at least about 2 feet forward of the keel rear limit.

8. A jet-propelled personal watercraft comprising:

a hull including a bottom hull and a top deck secured over the bottom hull, the hull defining an engine compartment sized to contain an internal combustion engine for powering a jet propulsion unit, the jet propulsion unit including a steerable water discharge nozzle, the top deck having a raised, longitudinally extending seat adapted to accommodate an operator in straddle fashion, the hull having a water inlet leading to the jet propulsion unit, the bottom hull including a length and a center keel portion extending longitudinally along at least a portion of the length and having a pair of opposing side surfaces, each side surface having a greatest downward slope, the center keel portion including a longitudinal keel section extending along a portion of the length between a front limit and a rear limit, the rear limit disposed within the middle third of the length of the bottom hull, wherein the greatest downward slope increases moving from the front limit to the rear limit.

9. A personal watercraft hull as in claim 8, in which the center keel portion is integrally formed with the hull.

10. A personal watercraft hull as in claim 8, in which the front limit lies within the middle third of the length.

11. A personal watercraft hull as in claim 8, in which the front and rear limits lie at least within 15 percent of either side of the middle of the hull length.

12. A personal watercraft hull as in claim 8, in which the front and rear limits lie at least within 10 percent of either side of the middle of the hull length.

13. A personal watercraft as in claim 8, in which the personal watercraft includes a jet pump, in which the rear limit of the keel section is disposed at about 1 foot forward of the jet pump and the keel section has a length of at least 2 feet.

14. A personal watercraft as in claim 8, in which the maximum vertical downward slope at a location 3 feet rearward of the hull front-most extent is less than the maximum vertical downward slope at a location 4 feet forward the hull rear-most extent.

15. A personal watercraft as in claim 8, in which the maximum vertical downward slope at a location 3 feet rearward of the hull front-most extent is less than the maximum vertical downward slope at a location 3 feet forward of the hull rearmost extent.

16. A personal watercraft as in claim 8, further comprising a keel trough on each side of the central keel portion, the keel trough defining a trough depth, wherein there exists a second longitudinal keel section extending over a second portion of the length, the trough depth increases from front to rear over the second longitudinal keel section.

17. A personal watercraft hull as in claim 8, in which the center keel portion is generally V-shaped.

18. A personal watercraft hull comprising:

a bottom hull having a rear extent, an opposing front extent and a length extending therebetween; and a center keel strip extending longitudinally along a centerline of the bottom hull and including a center keel portion, the center keel portion having a generally V-shaped cross-section extending over the middle third of the length of the bottom hull, the center keel strip including a keel trough on each side of the keel portion, the keel trough having a depth;

wherein there exists a longitudinal keel section of the center keel strip having a section length, the trough depth of the portion of the keel trough extending along the side of the section length increases from front to rear;

the hull includes a jet pump, in which the center keel portion begins within about 2 feet forward of the jet pump and has a length of at least three feet.

19. A personal watercraft hull as in claim 18, wherein the center keel strip has a width, the width is about 10 inches or less.

20. A personal watercraft hull as in claim 18, wherein the trough depth is a normal depth defined as the largest normal over the trough.

21. A personal watercraft hull as in claim 18, in which the trough depth is a vertical depth measured from a mid-point of the trough.

22. A personal watercraft hull as in claim 18, in which the keel section lies within the middle third of the hull length.

23. A personal watercraft hull as in claim 18, in which the hull includes a jet pump, in which the center keel portion begins about 1½ feet forward of the jet pump and has a length of at least three feet.

24. A personal watercraft hull comprising:

a bottom hull having a rear extent, an opposing front extent and a length extending therebetween; and a center keel strip extending longitudinally along a centerline of the bottom hull and including a center keel portion, the center keel portion having a generally V-shaped cross-section extending over the middle third of the length of the bottom hull, the center keel strip including a keel trough on each side of the keel portion, the keel trough having a depth;

wherein there exists a longitudinal keel section of the center keel strip having a section length, the trough depth of the portion of the keel trough extending along the side of the section length increases from front to rear;

the center keel portion includes a pair of opposing side surfaces, each of the side surfaces having a maximum vertical downward slope, the maximum vertical downward slope at a point 3 feet rearward of the hull front-most extent is less than the maximum vertical downward slope at a point 4 feet forward the hull rear-most extent.

25. A personal watercraft hull comprising:

a bottom hull having a rear extent, an opposing front extent and a length extending therebetween; and a center keel strip extending longitudinally along a centerline of the bottom hull and including a center keel portion, the center keel portion having a generally V-shaped cross-section extending over the middle third of the length of the bottom hull, the center keel strip including a keel trough on each side of the keel portion, the keel trough having a depth;

wherein there exists a longitudinal keel section of the center keel strip having a section length, the trough depth of the portion of the keel trough extending along the side of the section length increases from front to rear;

the center keel portion includes a pair of opposing side surfaces, each of the side surfaces having a maximum vertical downward slope, the maximum vertical downward slope forms a side angle from the vertical, the side angle decreases to form a more acute and more vertical angle from front to rear over the section length.

26. A personal watercraft hull including a rear tunnel, the hull comprising:

a center keel portion including a generally V-shaped keel, wherein there exists a longitudinal keel section of the center keel portion having concave areas located on either side of the keel, wherein the keel section has a length being located within the middle third of the length of the hull over which the concavities get deeper toward the rear;

the keel has a side angle from vertical and the side angle gets smaller over the length of the section.

27. A personal watercraft hull as in claim 26, in which the keel section length is at least about 2 feet long.

28. A personal watercraft hull as in claim 26, in which the keel section length is at least about 1 foot long.

* * * * *